US006570543B1

(12) United States Patent
Solberg, Jr. et al.

(10) Patent No.: US 6,570,543 B1
(45) Date of Patent: May 27, 2003

(54) CONFORMAL, HIGH-FREQUENCY, DIRECTION-FINDING ANTENNA

(75) Inventors: Ruell F. Solberg, Jr., San Antonio, TX (US); Steven P. Saulnier, San Antonio, TX (US); C. Nils Smith, San Antonio, TX (US); William G. Guion, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 10/010,822

(22) Filed: Nov. 13, 2001

(51) Int. Cl.[7] ..... H01Q 7/04; H01Q 1/52
(52) U.S. Cl. ..... 343/787; 343/842
(58) Field of Search ..... 343/787, 726, 343/788, 842, 872, 728, 727

(56) References Cited

U.S. PATENT DOCUMENTS

| | | | | |
|---|---|---|---|---|
| 2,977,591 A | | 3/1961 | Tanner | |
| 3,078,461 A | | 2/1963 | Dwyer | |
| 3,329,954 A | | 7/1967 | Travers | |
| 3,623,116 A | * | 11/1971 | Green | 343/788 |
| 4,407,000 A | * | 9/1983 | Sasaki et al. | 343/726 |
| 4,651,152 A | | 3/1987 | Harmuth | |
| 5,036,323 A | | 7/1991 | Cain et al. | |
| 5,099,242 A | | 3/1992 | Jaggard et al. | |
| 5,159,332 A | * | 10/1992 | Walton | 340/825.54 |
| 5,568,162 A | * | 10/1996 | Samsel et al. | 343/842 |
| 5,661,484 A | | 8/1997 | Shumaker et al. | |

* cited by examiner

*Primary Examiner*—James Clinger
(74) *Attorney, Agent, or Firm*—Guan, Lee & Hanor, P.C.; Michelle Evans

(57) ABSTRACT

A direction-finding antenna that conforms to flat and semi-flat surfaces is disclosed. It has a low profile in comparison to most existing direction-finding antennas and its surfaces are shaped so that reduced radar reflections and reduced radar cross sections of the antenna assembly are achieved. The antenna assembly has direction-finding characteristics that are essentially equivalent to traditional antennas that have high profiles and that are mounted high and away from external surfaces of platforms for unobstructed views of arriving electromagnetic energy and away from reflected electromagnetic waves and reradiators.

8 Claims, 6 Drawing Sheets

CONFORMAL, HIGH-FREQUENCY, DIRECTION-FINDING ANTENNA

BACKGROUND OF THE INVENTION

1. Field of The Invention

Applicants' invention relates to devices that serve as antennas to receive and transmit electromagnetic energy. More specifically, the present invention relates to the use of antennas for direction-finding systems, particularly in the high frequency band of operation. The antennas are designed and fabricated to be conformable to flat and semi-flat surfaces and to have low levels of radar reflections. These characteristics provide certain advantages, particularly with respect to their being more difficult to observe or detect, especially by radar.

2. Background Information

Presently, antennas are used in many configurations and with many different electrical connections to receive and transmit electromagnetic energy. Some antennas are very simple, such as antennas for car radios, but other antennas have large numbers of antenna elements in complex geometric arrays with very complex electrical connections between the elements. A common feature of all antennas is that they convert electrical energy into electromagnetic energy (transmit antennas) or electromagnetic energy into electrical energy (receive antennas).

Radio direction-finding (DF) is the process of determining the direction of arrival of a radio signal transmission. There are numerous direction-finding antennas and systems in the prior art.[1] The techniques for obtaining bearings of an emitter and using triangulation to estimate target positions are well-known. The ability to ascertain the geographical location of an emitting transmitter offers important capabilities for many modern communications applications—such as land, air, and sea rescue, duress alarm and location, law enforcement, and military intelligence.

Some receiving antennas can be used for radio direction-finding purposes. There are a number of suitable types of antenna elements which can be positioned with respect to each other in different configurations. Examples of types of antenna elements include monopoles, dipoles, simple loops, and ferrite-loaded simple loops. Configurations include Adcocks, dipole Adcocks, quadrupole Adcocks, Rocke Adcocks, spaced loops, simple loops, Doppler arrays, and arbitrary arrangements used with vector-matching DF algorithms. Also, the antenna configuration can be rotating or non-rotating and fixed or mobile.

Typically, direction-finding antennas have been mounted high and/or on the external surfaces of platforms so they have unobstructed views of the arriving electromagnetic energy and are not near surfaces or objects from which the electromagnetic energy reflects or reradiates. This is especially desirable when the platform on which they are mounted is a ship, airplane, land vehicle, or building.

Herndon H. Jenkins, *Small Aperture Radio Direction-Finding*, Artech House, Inc., Norwood, Mass., 1991; Douglas N. Travers, "Eight Loop Antenna System and Method of Scanning Same", U.S. Pat. No. 3,329,954, issued Jul. 4, 1967; Terry C. Green and Ruell F. Solberg, Jr., "Ferrite Core Crossed Spaced Loop Antenna", U.S. Pat. No. 3,623,116, issued Nov. 23, 1971.

Recent developments of computer capabilities, software, algorithms, and vector-matching DF techniques loosen the previous requirements of clean site responses from DF antennas. This allows antennas to be mounted in much less ideal locations. However, it is then more important that variability between antennas be reduced, so the direction-finding antenna characteristics not vary from antenna to antenna.

An inherent disadvantage of conventional direction-finding antennas is they have high reflections of radar signals. For certain conditions, such as during war, stealth or low observability characteristics are very important, and various techniques to reduce radar echoes have been used.[2] Determining the radar cross section (RCS) of objects is another way to characterize and compare radar reflections from objects. RCS is a measure of the electromagnetic scattering from a target observed by radar. RCS is a function of the physical cross section area, shape, material, and orientation of the target and the frequency and polarization of the incident energy.[3]

J. Wayne Burns, "Introduction to Stealth Technology and Stealth Aircraft Weight Penalties", SAWE Journal, Vol. 53, No. 1, Fall 1993, pp. 40–58; Roger A. Stonier, "Stealth Aircraft and Technology from World War II to the Gulf, Part I: History and Background", SAMPE, Vol. 27, No. 4, July/August 1991, pp. 9–17; Roger A. Stonier, "Stealth Aircraft and Technology from World War II to the Gulf, Part II: Application and Design", SAMPE Journal, Vol. 27, No. 5, September/October 1991, pp 9–18; R. Neal Cain and Albert J. Corda, "Active Radar Stealth Device", U.S. Pat. No. 5,036,323, issued Jul. 30, 1991; Dwight L. Jaggard and Nader Engheta, "Novel Shielding, Reflection, and Scattering Control Using Chiral Materials", U.S. Pat. No. 5,099,242, issued Mar. 24, 1992; Gene P. Shumaker and Walter B. Mays, "Multi-Fiber Species Artificial Dielectric Radar Absorbing Material and Method for Producing Same", U.S. Pat. No. 5,661,484, issued Aug. 26, 1997; Walter J. Dwyer, "Dished Annular, Radiofrequency Absorber and Method of Manufacture", U.S. Pat. No. 3,078,461, issued Feb. 19, 1963.

W. M. Cady, M. B. Karlitz, and L. A. Turner, *Radar Scanners and Radomes*, McGraw-Hill Book Co., New York, 1984; Eugene F. Knott, John F. Schaeffer, and Michael T. Tuley, *Radar Cross Section: Its Prediction, Measurement and Reduction*, Artech House, Norwood, Massachusetts, 1985; George T. Ruck, ed., *Radar Cross Section Handbook*, Plenum Press, New York, Vol. 2, 1970, "Chapter 8. Complex Bodies", (G. T. Ruck), pp. 539–670.

Antennas that have much lower radar reflections, and much lower radar cross sections, have significant advantages when low observability is important. The present invention is a high-frequency (HF) antenna that has been designed to have much lower radar reflections. The HF range is defined to be 0.5 to 30 megahertz (MHz). The height of the present invention is on the order of a magnitude less than conventional high frequency antennas. The general profile area of the antenna assembly that radar transmissions would reflect from is much less. In addition, the surfaces that reflect radar energy are designed so the radar energy is reflected in directions that will not be received back at the site of the radar transmitter. These surface angles have been applied, for example, to the ferrite bar surfaces, the antenna base plate, and the antenna cover. Also, the intersections of the ferrite bars have corners at angles to reduce the radar reflections back to the transmitter. In addition, materials are used, such as for the antenna cover, that have inherently low radar reflectivity, and radar absorbing materials (RAM) can be used on the inside of the antenna cover and on surfaces of the ferrite bars and in the corners of their intersections with each other.

The present invention has other good low observable characteristics to make it difficult to detect by not only enemy radar, but also infrared and optical detection systems. No power is sent to the antenna assembly of the present invention. Since the antenna is passive, it does not generate heat and, therefore, does not have a large infrared signature. Since it has a low physical profile and can easily conform to surfaces of objects, its optical visibility is very low. The color of the antenna can be such that it matches the color of its platform. Also, it lends itself to being camouflaged.

Fighter and bomber airplanes that have stealth qualities have advanced significantly. The F-117A and the B-2 have physical characteristics that are distinguishable from other airplanes and are easily recognized visually. The advancement of surface ships for low observability or very low observability is still in the early stages. However, ships being developed with stealth qualities include the La Fayette stealth frigate in France, the Sea Wraith stealth corvette by Vosper Thornycroft in the United Kingdom, the Visby class of corvette in Sweden, and the DD 21 in the United States.

In general, these new surface ships have smooth, radar-defeating exterior shapes. Their radar dishes and antennas are typically enclosed within towers or other structures or they are blended into the ship structures.

SUMMARY OF THE INVENTION

It is an object of the present invention to provide a novel antenna which will conform to flat and nearly flat surfaces and to provide optimal direction-finding accuracy and sensitivity with low observability, especially with low radar reflectivity and low radar cross section characteristics.

It is another object of the present invention to provide a novel antenna with a much lower physical profile than existing antennas.

Still another object of the present invention is to provide a novel antenna that lends itself for use on ships, airplanes, buildings, and other platforms for which conformal shaping is a high priority.

It is another object of the present invention to provide a new and improved, high-frequency direction-finding antenna assembly.

Another object of the present invention is to provide a novel antenna for which satisfactory operation does not depend as critically on the placement location of the antenna on platforms as existing antennas do.

Yet another object of the present invention is to provide a novel antenna for use in wartime and during hostile conditions.

It is another object of the present invention to provide a novel antenna partially constructed of a ferrite material.

Still another object of the present invention is to provide a novel antenna that is economically manufactured, installed, maintained, and operated.

Another object of the present invention is to provide a novel antenna that is more resistant to environmental damage.

Yet another object of the present invention is to provide a novel antenna that is useful for search and rescue.

In satisfaction of these and related objectives, applicants' present invention provides an antenna with these characteristics where the antenna is constructed of metal, ferrite, plastic, and composite materials. In times of military confrontations, this invention will be particularly useful to its practitioner. With the current use of large, metal antennas near the tops of platforms, radar reflectivity of the antenna is so high that adversaries can detect the practitioner's ship from significant distances. In contrast, with a conformal, shaped antenna like that of the present invention, the radar reflectivity is reduced and an observer would have to be much closer before detecting the practitioner or the power of the radar would have to be significantly increased, which would, in turn, increase the detectability of the observer's radar.

DETAILED DESCRIPTION OF THE PREFERRED EMBODIMENT

When two adversaries are trying to detect and locate each other, techniques to reduce their observability are important. Each wants to lessen the likelihood of being detected. Conventional sensors that are used to obtain information about the location of radio transmitters are direction-finding antennas. The conventional, preferred locations of direction-finding antennas are high on external surfaces of platforms (such as ships) and away from other structures and objects. Since conventional direction-finding antennas are made from metal structures (typically cylindrical) with high profiles, they increase the radar reflectivity of the vehicles or platforms on which the antennas are mounted. It is known that the shape of the object and/or the use of radar absorbing materials can be used to reduce the visibility of that object to radar.

Figure 1A:
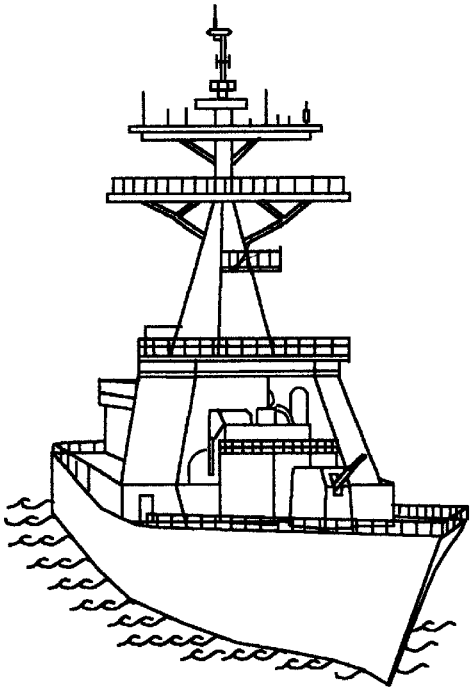
FIG. 1A is a perspective view of a ship with a DF antenna that is mounted near the top of the ship's mast.
Figure 2:
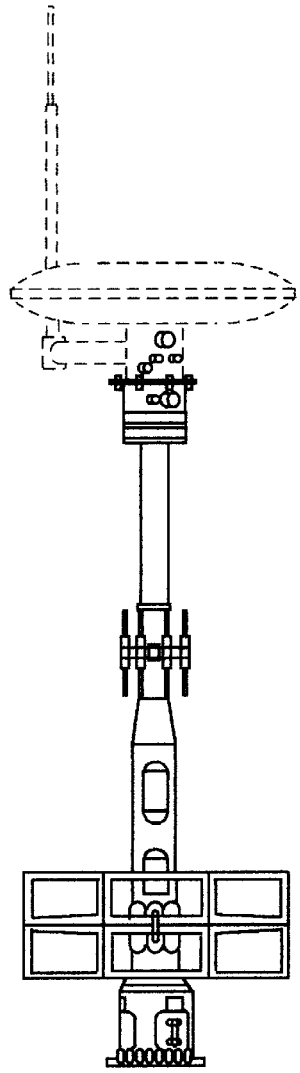
FIG. 2 is more detailed perspective view of a DF antenna designed for mast mounting.
Figure 1B:
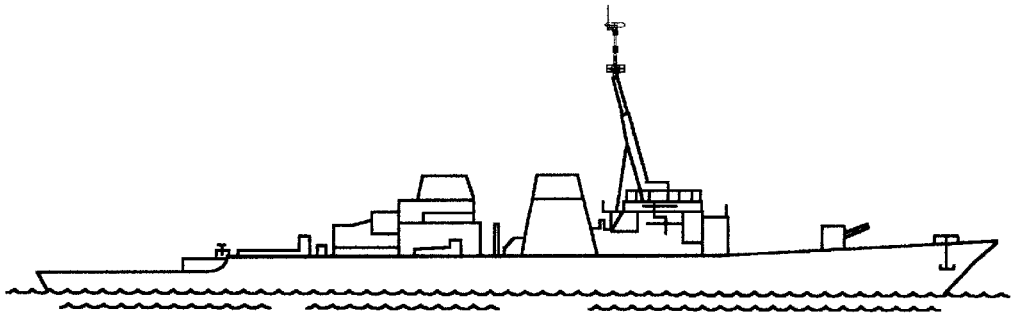
FIG. 1B is a side view of a ship with a DF antenna that is mounted near the top of the mast.
Figure 3:
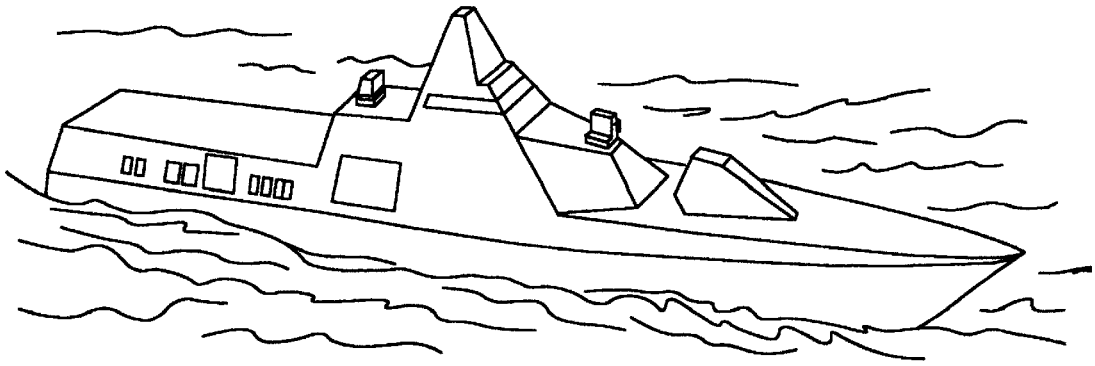
FIG. 3 is a perspective view of a new stealth ship.

Using naval ships as an example of the platform that the DF antennas are mounted on, FIGS. 1A and B show a DF antenna that is mounted near the top of the mast of a ship. Some details of a DF antenna that was designed for mast mounting can be seen in FIG. 2. The antenna shown by dashed lines is not a DF antenna; it is a tactical air navigation antenna that is often placed at this location. FIG. 3 illustrates a new stealth ship for which the antennas are integrated into the ship's superstructure. Obviously, DF antennas like those depicted in FIG. 2 that are mounted high on a ship do not lend themselves to the new stealth ship because such a high profile antenna that does not blend into the ship's configuration adversely affects the desired stealth characteristics.

Figure 4:
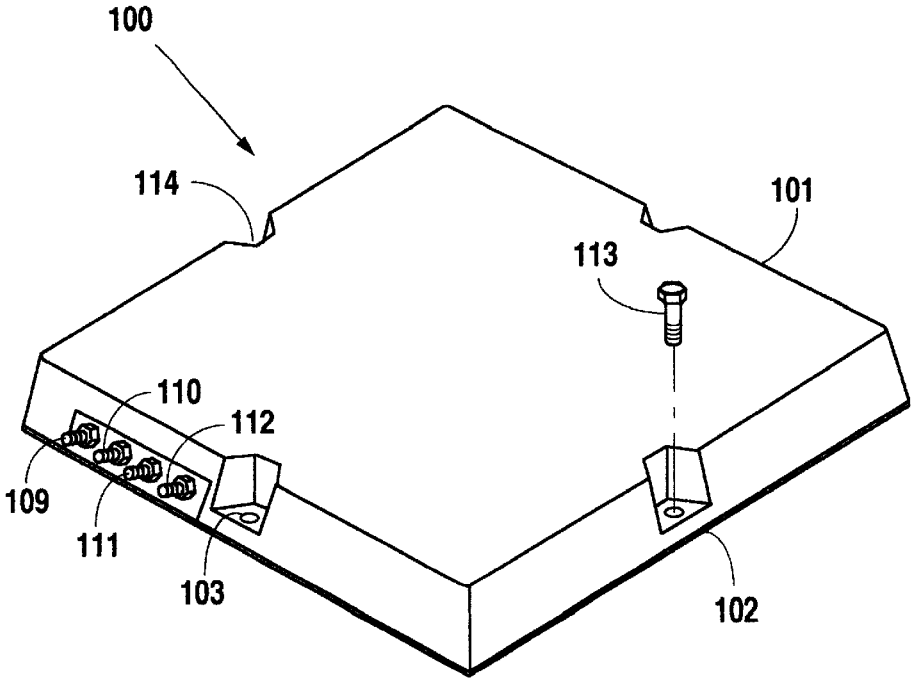
FIG. 4 is a perspective view of the preferred embodiment of the DF antenna of the present invention.
Figure 5:
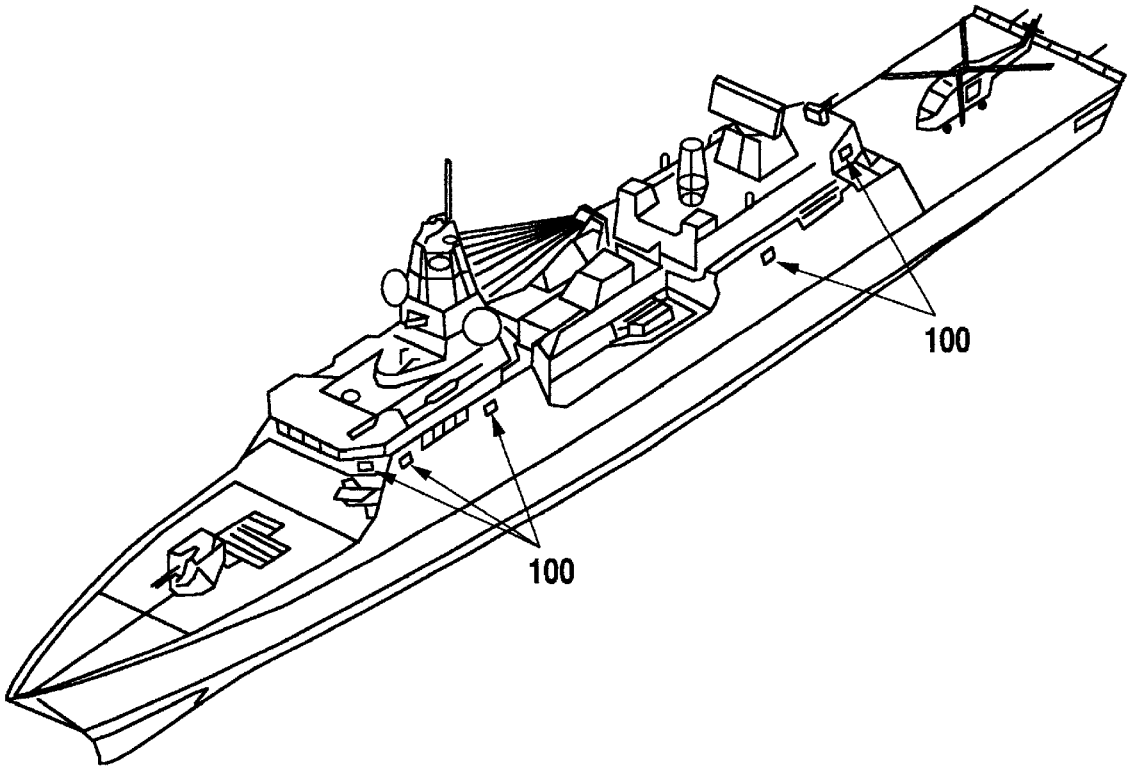
FIG. 5 shows acceptable locations for the preferred embodiment of the present invention on a typical conventional naval ship.

The present invention provides several benefits over existing antenna assemblies and lends itself for use on the stealth ship of FIG. 3. FIG. 4 is a perspective view of the preferred embodiment of the DF antenna of the present invention. In comparison to FIG. 2, significant differences are readily apparent. The exterior of the antenna assembly 100 is very smooth and simple. The height compared to the width and depth and in absolute terms is greatly reduced. The preferred embodiment is preferably approximately 20 inches long by approximately 20 inches wide by 3.5 inches tall and covered by an antenna cover 101. The sides of antenna cover 101 are angled at preferably approximately 10 from being square to base plate 102. FIG. 5 shows possible acceptable locations of the preferred embodiment of the present invention on a typical conventional naval ship. The antenna assembly 100 no longer has to be mounted near the top of the mast of a ship and blends into surfaces of the ship. In addition, the number of acceptable locations on a ship for mounting the new DF antenna assembly 100 has increased many times.

Referring to details of FIG. 4, three electrical connectors 110–112 are shown, two for transmitting the electrical output from the antenna assembly 100 to receivers or processors (not shown) which will provide the outputs used to determine direction of arrival information of the intercepted radio signal and one for RF test injection. A stud 109 near the electrical connectors 110–112 is for attachment of a ground strap or cable (not shown). The four recessed areas 114 around the exterior of the DF antenna assembly 100 are for mounting the antenna assembly 100 of the present invention. The recessed areas 114 have sides at angles of preferably 10° to minimize radar reflections and have holes 103 (See FIG. 6A) at their base for insertion of fasteners 113 for mounting. Fasteners 113 can be of any strong, durable material such as, but not limited to, stainless steel.

Figure 6A:
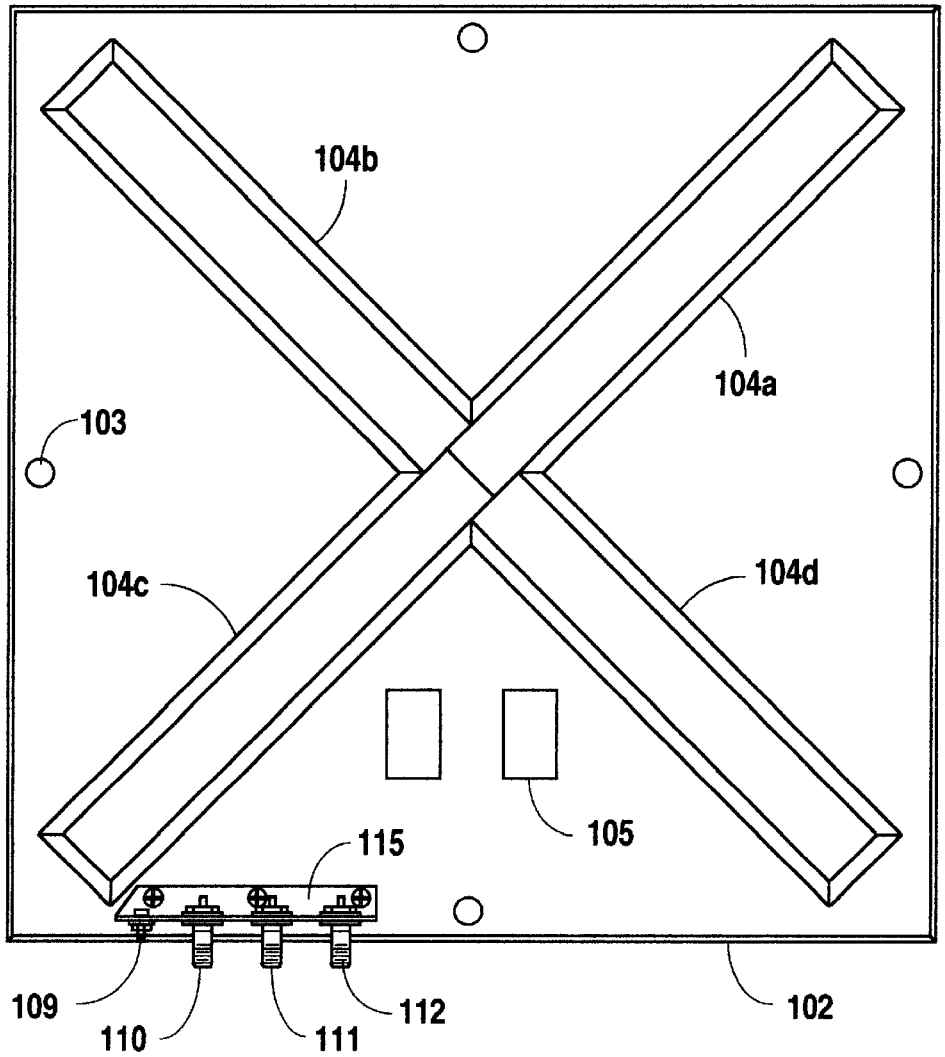
FIG. 6A is a plan view of the preferred embodiment of the DF antenna of the present invention with the cover and electrical cables and wires removed.
Figure 6B:
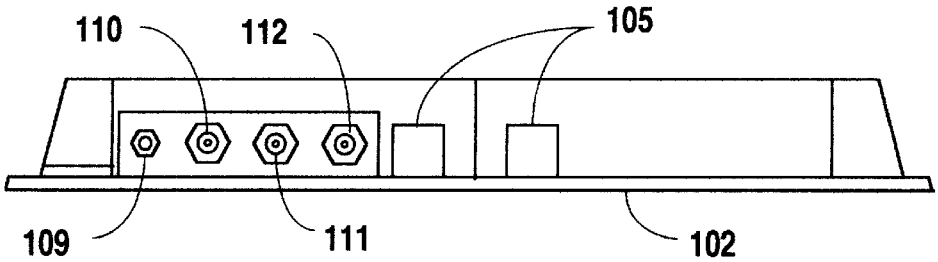
FIG. 6B is a side view of the preferred embodiment of the DF antenna of the present invention with the cover and electrical cables and wires removed.
Figure 6C:
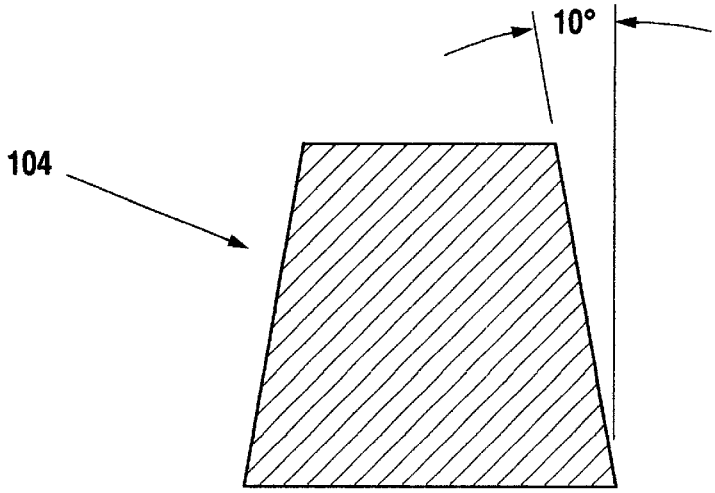
FIG. 6C is a cross section of a ferrite bar.

FIGS. 6A and B show a plan view and side view, respectively, of the preferred embodiment with the antenna cover 101 removed. Also, electrical cables and wires are not shown in these views. FIGS. 6A and B show items mounted on a, preferably metal base plate 102. A composite material can be substituted for the metal of the base plate 102. The base plate 102 also serves as a conductive ground plane. The four holes 103 near the center of each side are for mounting the antenna assembly 100 to platforms. A total of four ferrite bars 104*a–d* of two different configurations are positioned preferably in a cross or x-shape and are attached to the base plate 102 by conventional means. Bars 104*a–d* have a preferable cross section as given by FIG. 6C. They have dimensions and shapes that give an overall 4 square inch cross sectional area; however, all of these dimensions and angles can vary. When bars 104*a–d* are positioned together, their intersections are angled to reduce radar reflections. Balun transformers 105 are attached to the base plate 102 by conventional means.

Figure 7:
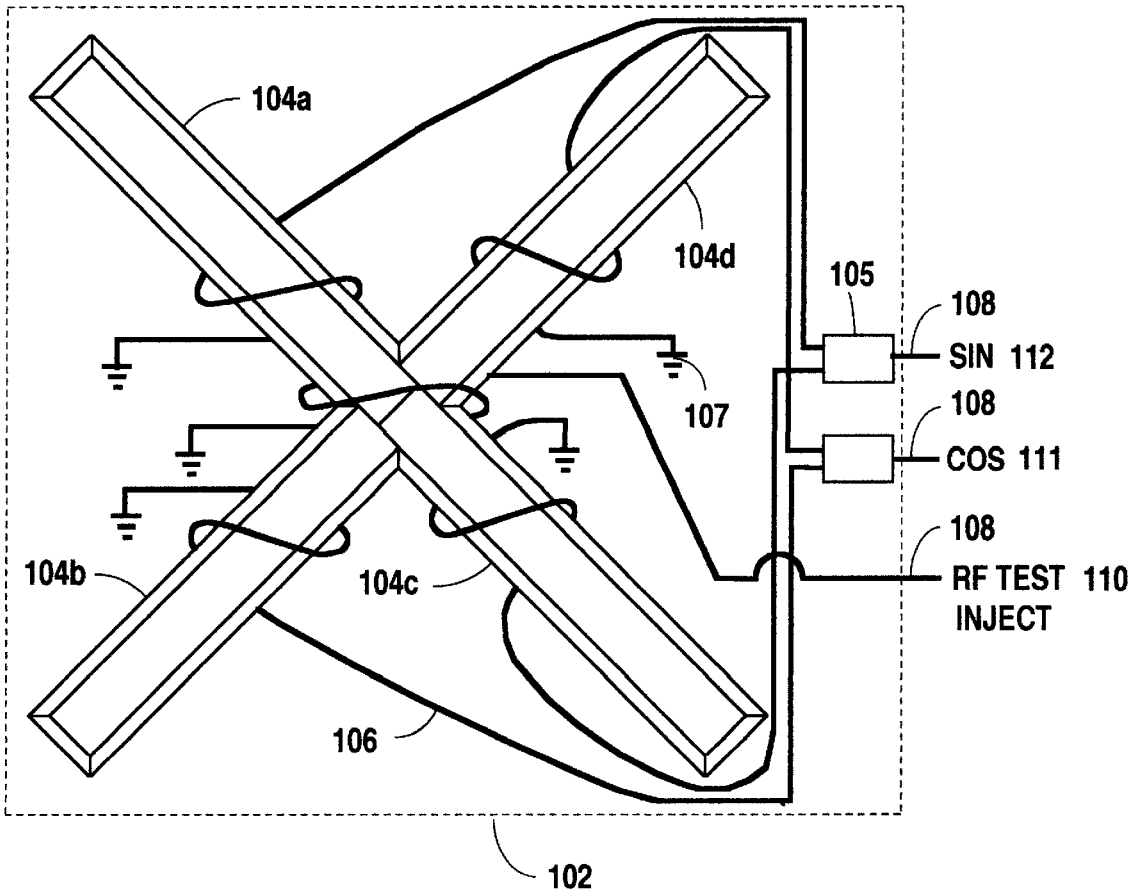
FIG. 7 is an electrical schematic of the antenna assembly of the present invention.

FIG. 7 is an electrical schematic of the antenna assembly 100 of the present invention. Electrically conductive coils 106 having at least one turn around each of the four bars 104*a–d* connect to ground studs 107 on the base plate 102 and to the balun transformers 105. Coils 106 can be of any material and dimension standard in the industry. When base plate 102 is a non-conductive material, the ground connection may be modified such that coils 106 connect to a common ground stud before the external ground stud 109. Balun transformers 105 connect the balanced two wire system to an unbalanced coaxial transmission line 108. Lines 108 then connect the balun transformers 105 and center coil 106 to the electrical connectors 110–112 to provide the outputs and RF test injection input of the antenna assembly 100. The antenna assembly 100 has two independent outputs: SIN (sine) 112 and COS (cosine) 111. The purpose of the RF TEST INJECT 110 is to provide a means to inject an electrical signal to the antenna assembly 100 for testing and trouble-shooting purposes.

An intermediate plate (not shown) between the bars 104*a–d* and the base plate 102 is composed of one or more printed circuit boards. The printed circuit board(s) has electrically conductive patterns (not shown) on its surface along with a plurality of holes (not shown). Slots cut into the circuit board serve to position the coils 106 as they make one or more turns around each bar 104*a–d* and their intersection. A conductive wire or bar is utilized for all sides of the coils 106, with its ends being soldered to appropriate locations on the printed circuit board. Then, the conductive pattern leg with the conductive wire or bar encircles the appropriate bar. Center coil 106 for RF TEST INJECT 110 encircles the intersection of the four bars 104*a–d*.

Conductive patterns on the printed circuit board also provide the appropriate connections to the two baluns 105 and to jumper wires or cables which connect to the output electrical connectors 110–112. An alternate method is to integrate the conductive patterns into the base plate 102 or an intermediate plate that is fabricated from printed circuit board material.

The printed circuit board is attached to the base plate 102 with adhesive in the form of sheets, liquid drops, or paste. Also, the bars 104*a–d* are attached to the printed circuit board with adhesive and/or mechanical fasteners. In addition, nonmetallic brackets can be used to position and attach bars 104*a–d* when increased ruggedness is required.

All of the components of the antenna assembly 100 above the base plate 102, except for the connector bracket 115 (See FIGS. 6A and B) and the connectors 110–112 and external ground stud 109 mounted on it, are enclosed by an antenna cover 101. The antenna cover 101 is fabricated from a preferably nonmetallic material that does not affect the performance of the antenna assembly 100, such as a fiberglass composite material. The antenna cover 101 can also be formed to the shape shown from various plastic materials. The inside surfaces can have RAM sheet attached to them with adhesives. Ruggedness, particularly for withstanding shock and vibration, of the antenna assembly 100 will be increased significantly if the remainder of the antenna interior is filled with a potting compound. A nonmetallic potting compound that is standard in the industry for protection of electrical components can be used.

Figure 8A:
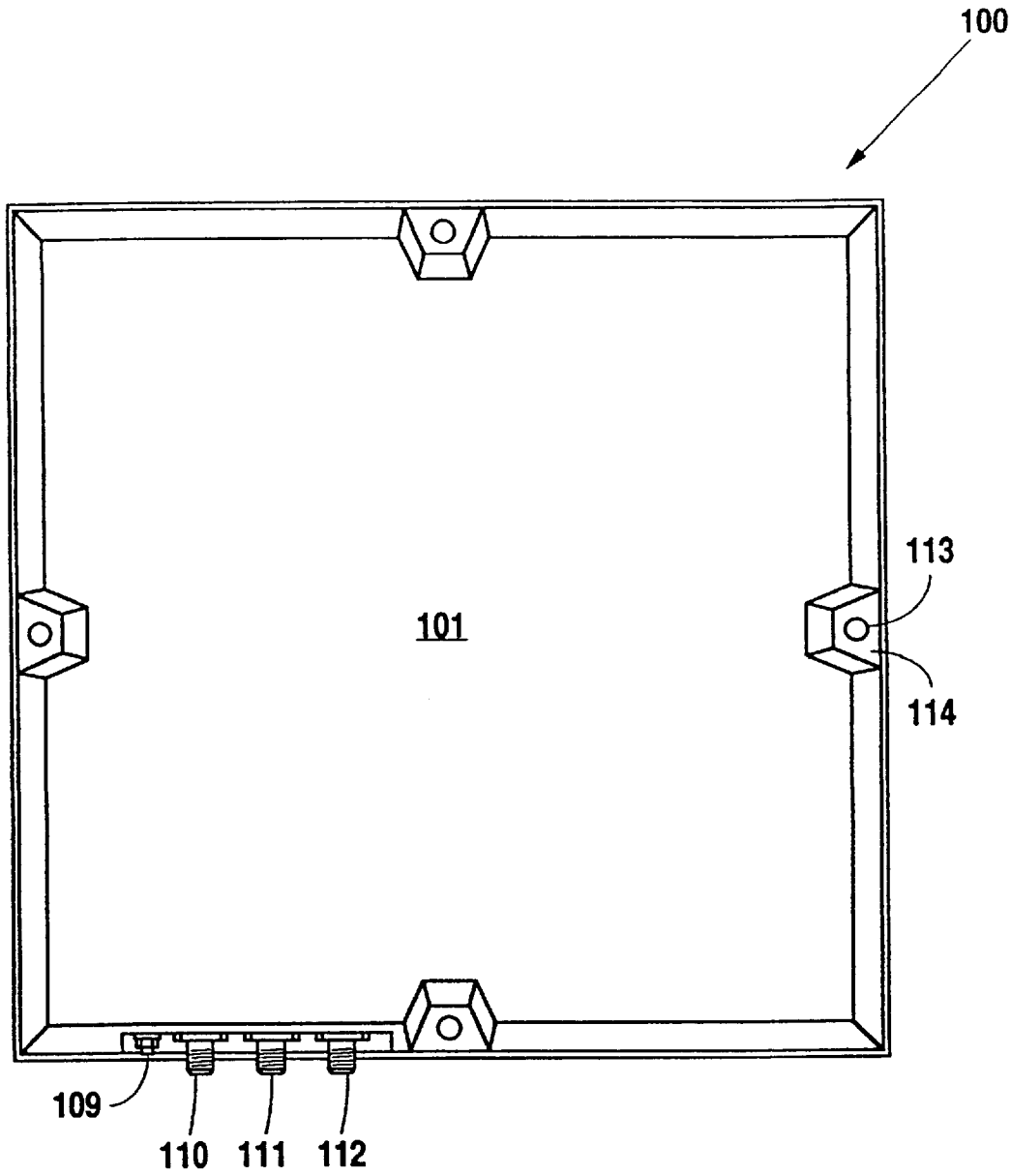
FIG. 8A is a plan view of the assembled preferred embodiment of the DF antenna of the present invention.
Figure 8B:
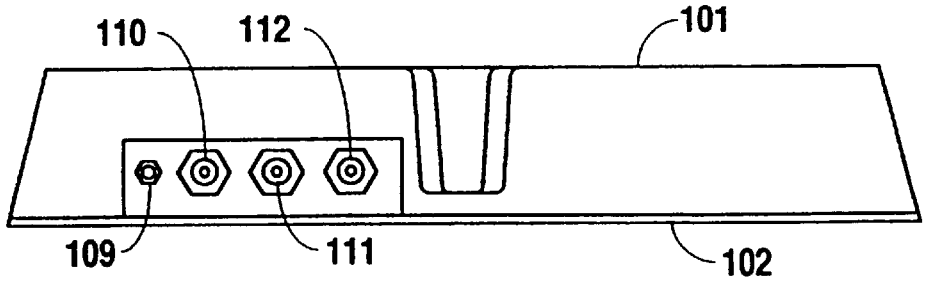
FIG. 8B is a side view of the assembled preferred embodiment of the DF antenna of the present invention.

FIGS. 8A and B show a plan view and side view respectively of the assembled antenna 100 of the present invention. The antenna assembly 100 can be classified as a ferrite-core, crossed-loop type of antenna. Amplifiers (not shown) external to the antenna assembly 100 can be used with the antenna assembly 100. The antenna assembly 100 is broadband for the HF range with no band switching, turn switching, or tuning required.

To summarize, the present invention has a much lower physical profile than conventional DF HF antennas, has a shape which conforms to flat and near-flat surfaces, and has piece parts designed such that the assembly will have much lower observability characteristics. Its radar reflectivity and radar cross section are significantly lower. Also, it can be mounted in many more locations on platforms with increased flexibility for those locations. The use of printed circuit boards with electrically conductive surface patterns and specific wire connections greatly increases registration, accuracy, and repeatability of specific antenna fabrication details. Consistency of antenna characteristics improves the performance of DF systems. In addition, the complexity of the antenna assembly 100 is reduced, the costs to fabricate, install, maintain, and operate the antenna assembly 100 are reduced and the production time is reduced.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A conformal direction-finding antenna with electronics for receiving radio signals in a frequency range of about 0.5 megahertz to about 30 megahertz, said direction finding antenna comprising:

a base plate;

four ferrite bars attached to said base plate, said bars being shaped and positioned together at angles to reduce radar reflections;

connectors, cables, and wires for connecting said ferrite bars to said electronics to receive said radio signals for delivery to a processor to process said radio signals to determine the direction of arrival of said radio signal for locating the source of said radio signal emitter wherein said connectors further comprise sine and cosine directional outputs;

an antenna cover fitted over said base plate and said ferrite bars for protecting said electronics within said conformal direction-finding antenna, said antenna cover having angled sides to reduce radar reflections; and at least one balun transformer attached to said base plate wherein said balun transformer is connected to electrically conductive coils having at least one turn extending around each of said ferrite bars.

2. The conformal direction-finding antenna of claim 1 wherein said connectors further comprise a means for injection of electrical signals to said direction-finding antenna for testing and troubleshooting purposes.

3. The conformal direction-finding antenna of claim 2 further comprising an intermediate plate between said plurality of ferrite bars and said base plate and composed of at least one printed circuit board.

4. The conformal direction-finding antenna of claim 1 wherein said electrically conductive coils are extended with conductive patterns on a printed circuit board.

5. A method of operating a conformal direction-finding antenna in a location where it may receive incident electromagnetic energy from radios and radars, said method of operation comprising the steps of:

receiving a radio signal through said conformal direction-finding antenna wherein said receiving step is accomplished with a plurality of ferrite bars attached to a base plate within said antenna;

simultaneously providing a low level radar echo due to the conformal direction-finding antenna having an antenna cover with sides angled in such a way as to reduce radar reflections and said plurality of ferrite bars shaped and positioned together at such angles as to reduce radar reflections; and delivering said radio signal to a processor to process said radio signal to determine the direction of arrival of said radio signal for locating the source of said radio signal emitter wherein said processing is accomplished with electrical connectors and cables and balun transformers attached to said base plate; wherein said connectors and balun transformers of said processing step are connected to electrically conductive coils having at least one turn extending around said plurality of ferrite bars and wherein said connectors of said processing step further comprise sine and cosine directional outputs.

6. The method of operating a conformal direction-finding antenna of claim 5 further comprising the step of protecting the electronics within said antenna with an antenna cover.

7. The method of operating a conformal direction-finding antenna of claim 6 wherein said protecting step is accomplished with said antenna cover.

8. The method of operating a conformal direction-finding antenna of claim 6 wherein said protecting step is further accomplished with internal brackets and potting materials.

* * * * *